US008556072B2

(12) United States Patent
Bertuzzi et al.

(10) Patent No.: US 8,556,072 B2
(45) Date of Patent: Oct. 15, 2013

(54) PACKAGE COMPRISING A WRAPPING WITH A RECLOSABLE WITHDRAWAL OPENING, AND RELATIVE PACKING METHOD AND MACHINE

(75) Inventors: Ivanoe Bertuzzi, Casalecchio di Reno (IT); Roberto Polloni, Modigliana (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 41 days.

(21) Appl. No.: 13/008,210

(22) Filed: Jan. 18, 2011

(65) Prior Publication Data

US 2011/0226640 A1 Sep. 22, 2011

(30) Foreign Application Priority Data

Jan. 19, 2010 (IT) ..... BO2010A0028
Jan. 19, 2010 (IT) ..... BO2010A0031

(51) Int. Cl.
*B65D 85/10* (2006.01)

(52) U.S. Cl.
USPC ..... 206/265; 206/264; 206/273

(58) Field of Classification Search
USPC ..... 206/265, 264, 271, 273, 274; 229/160.1, 87.13
See application file for complete search history.

(56) References Cited

U.S. PATENT DOCUMENTS 4,155,439 A 5/1979 Fletcher et al.
4,286,712 A * 9/1981 Focke ..... 206/264
4,293,068 A * 10/1981 Focke et al. ..... 206/264
4,300,676 A 11/1981 Focke et al.
4,375,260 A * 3/1983 Focke et al. ..... 206/264
4,386,925 A * 6/1983 Focke ..... 493/338
6,164,444 A * 12/2000 Bray et al. ..... 206/268
6,505,735 B1 * 1/2003 Parker ..... 206/268
8,091,703 B2 * 1/2012 Marchetti et al. ..... 206/268

FOREIGN PATENT DOCUMENTS

EP 0 396 967 A2 11/1990
EP 2 008 935 A1 12/2008
GB 1 939 107 A1 7/2008
GB 2 451 180 A 1/2009

OTHER PUBLICATIONS

Partial European Search Report in respect of counterpart Application No. EP 11151050.9.

* cited by examiner

*Primary Examiner* — Andrew Perreault
(74) *Attorney, Agent, or Firm* — Ladas & Parry LLP

(57) ABSTRACT

A package of cigarettes having a group of cigarettes; and a sealed wrapping which encloses the group of cigarettes, has a cigarette withdrawal opening closed by a reclosable sealing panel, and is made from a sheet of multilayer packing material having at least an outer layer, and an inner layer superimposed with the outer layer and having a U-shaped first incision defining the withdrawal opening; the outer layer is larger than the sealing panel, and has a U-shaped second incision located outwards of the first incision, surrounding the first incision on three sides, and defining the edges of the sealing panel.

20 Claims, 12 Drawing Sheets

PACKAGE COMPRISING A WRAPPING WITH A RECLOSABLE WITHDRAWAL OPENING, AND RELATIVE PACKING METHOD AND MACHINE

TECHNICAL FIELD

The present invention relates to a package comprising a wrapping with a reclosable withdrawal opening, and to a relative packing method and machine.

For the sake of simplicity, reference is made in the following description, purely by way of a non-limiting example, to a rigid, hinged-lid packet of cigarettes.

BACKGROUND ART

A rigid, hinged-lid packet of cigarettes normally comprises an inner wrapping enclosing a group of cigarettes; and a rigid outer package housing the inner wrapping.

To preserve the organoleptic characteristics of the cigarette tobacco, a sealed inner wrapping, formed by folding and heat sealing a sheet of airtight packing material, is often used. The airtight material is fed to a packing machine in the form of a continuous strip wound into a reel, which is unwound gradually to cut the continuous strip crosswise into individual sheets of packing material. The airtight material is normally multilayer, i.e. comprises a number of joined, superimposed layers, which, to form a continuous strip of multilayer airtight material, must be unwound off respective reels to superimpose and join the layers to one another, and the continuous strip of multilayer airtight material then rewound into a reel for supply to the packing machine. If the layers in the airtight material, however, are not perfectly even (e.g. if one of the layers only covers a limited part of the material), the reel into which the continuous strip of multilayer airtight material is wound proves uneven (i.e. presents "eccentric bumps", as opposed to being perfectly round). This unevenness subjects the material to localized stress possibly resulting in undesired permanent (i.e. irreversible) formations, and may pose both winding and unwinding problems (due to pulsating variations in the tension of the strip).

EP1939107A1 describes a package, for confectionary or other foodstuffs, comprising a sealed wrapping with a reclosable withdrawal opening. The sealed wrapping has a withdrawal opening closed by a reclosable sealing panel, and is made from a sheet of multilayer packing material comprising at least an outer layer, and an inner layer superimposed with the outer layer and having a U-shaped first incision which defines the withdrawal opening. The outer layer is larger than the sealing panel, and has a U-shaped second incision located outwards of the first incision, surrounding the first incision on three sides, and defining the edges of the sealing panel.

DESCRIPTION OF THE INVENTION

It is an object of the present invention to provide a package comprising a wrapping with a reclosable withdrawal opening, and a relative packing method and machine, which package, method and machine are designed to eliminate the above drawbacks, while at the same time being cheap and easy to implement.

According to the present invention, there are provided a package comprising a wrapping with a reclosable withdrawal opening, and a relative packing method and machine, as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 3:
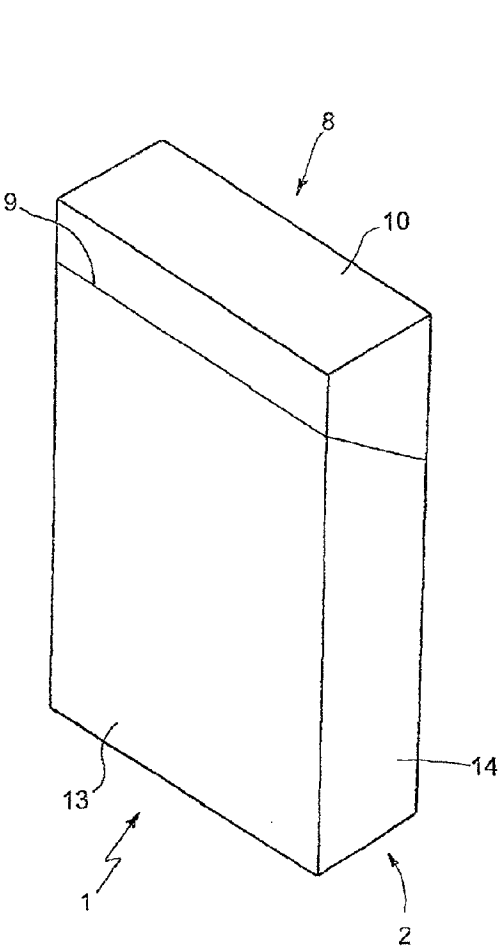
FIG. 3 shows a rear view in perspective of the FIG. 1 packet of cigarettes in a closed configuration.
Figure 2:
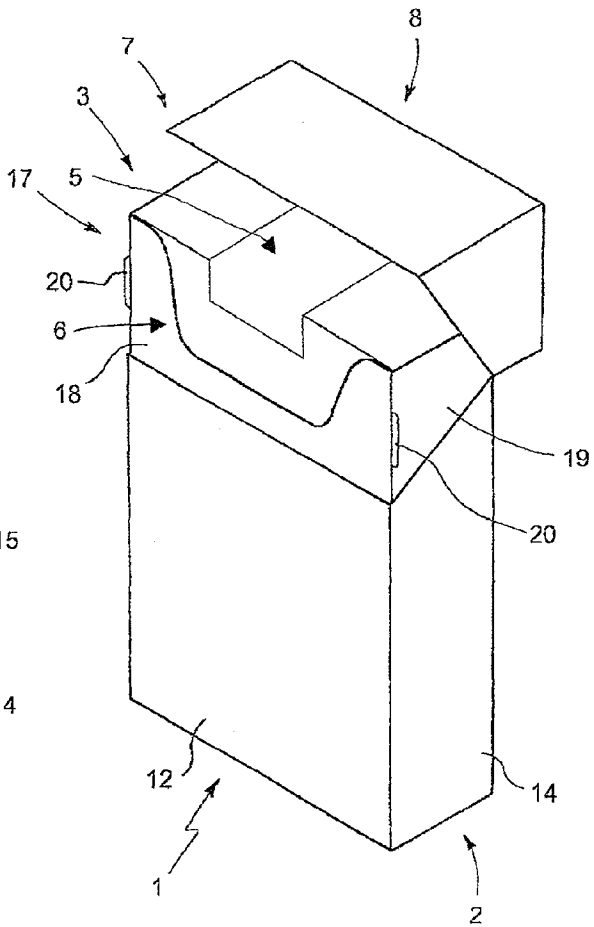
FIG. 2 shows a front view in perspective of the FIG. 1 packet of cigarettes in an open configuration, and with one detail removed for clarity.
Figure 1:
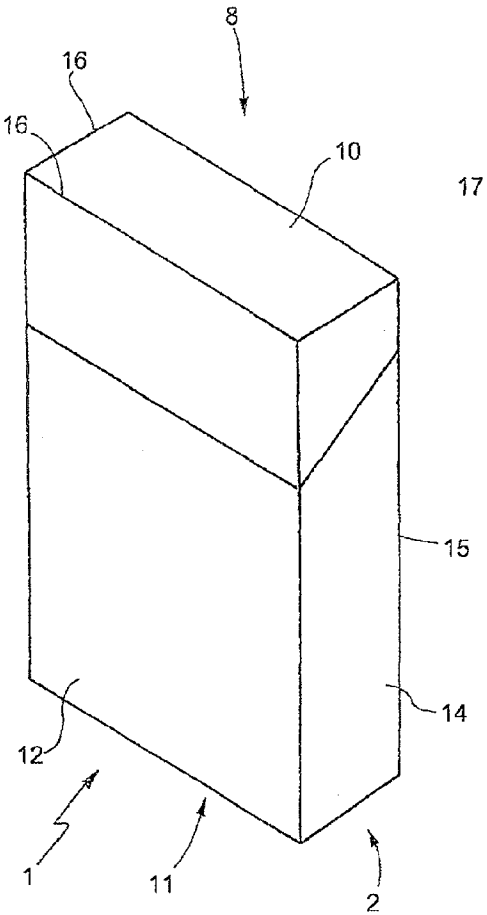
FIG. 1 shows a front view in perspective of a hinged-lid packet of cigarettes in a closed configuration.
Figure 4:
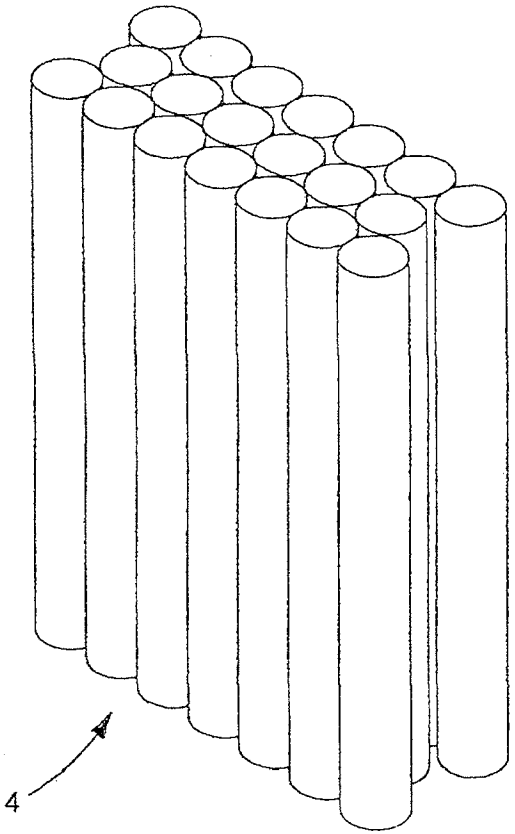
FIG. 4 shows a view in perspective of a group of cigarettes, which is enclosed in an inner wrapping of the FIG. 1-3 packet.

Number 1 in FIGS. 1, 2 and 3 indicates as a whole a rigid packet of cigarettes comprising a cup-shaped cardboard outer container 2, and a sealed wrapping 3 (FIG. 2) housed inside container 2. Sealed wrapping 3 encloses a parallelepiped-shaped group 4 of cigarettes (shown in FIG. 4), and has, at the top and front, a central cigarette withdrawal opening 5 extending over a portion of a front wall of sealed wrapping 3, and a portion of a top wall of sealed wrapping 3.

Outer container 2 has an open top end 7; and a cup-shaped lid 8 hinged to container 2 along a hinge 9 to rotate, with respect to container 2, between an open position (FIG. 2) and a closed position (FIGS. 1, 3) opening and closing open top end 7 respectively.

When lid 8 is closed, outer container 2 is in the form of a rectangular parallelepiped comprising a top wall 10 and a bottom wall 11 opposite and parallel to each other; two parallel, opposite major lateral walls and 13; and two parallel, opposite minor lateral walls 14. More specifically, one major lateral wall 12 defines a front wall 12 of outer container 2, and the other major lateral wall 13 defines a rear wall 13 of outer container 2. Four longitudinal edges 15 are defined between minor lateral walls 14 and front and rear walls 12, 13; and eight transverse edges 16 are defined between top and bottom walls 10, 11 and front, rear and lateral walls 12, 13, 14.

Packet 1 also comprises a collar 17, which is folded into a U and fixed (normally glued) to the inside of outer container 2, and projects partly outwards of open top end 7 to engage a corresponding inner surface of lid 8 when lid 8 is closed.

Collar 17 is made of cardboard, and comprises a front wall 18 positioned contacting front wall 12 of outer container 2; and two lateral walls 19 located on opposite sides of front wall 18, and which are positioned contacting minor lateral walls 14 of outer container 2.

In a preferred embodiment, collar 17 has two projections 20, which project laterally to interferentially engage the lateral walls of lid 8 to hold lid 8 in the closed position.

Figure 5:
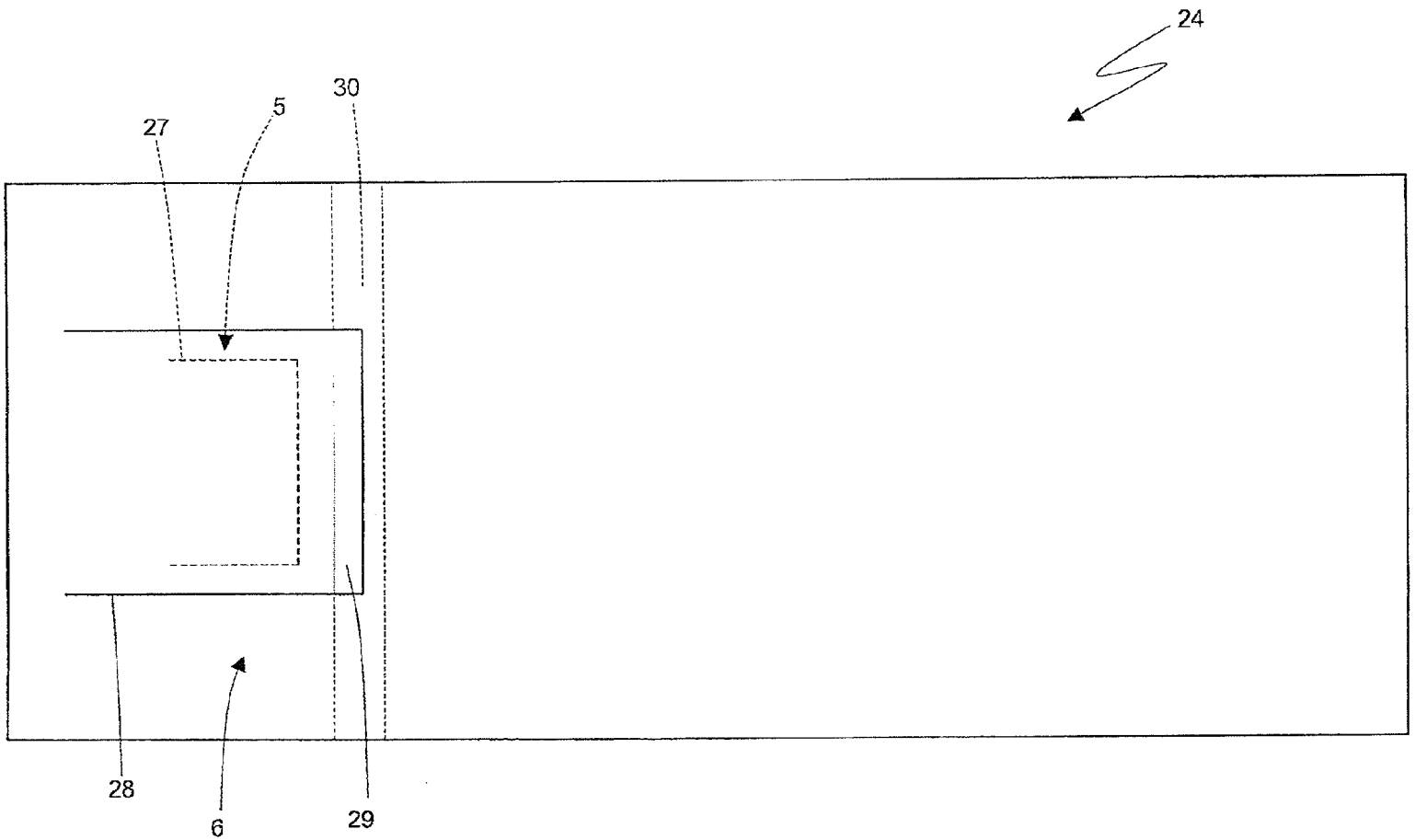
FIG. 5 shows a plan view of a sheet of multilayer packing material from which to form an inner wrapping of the FIG. 1-3 packet.
Figure 6:
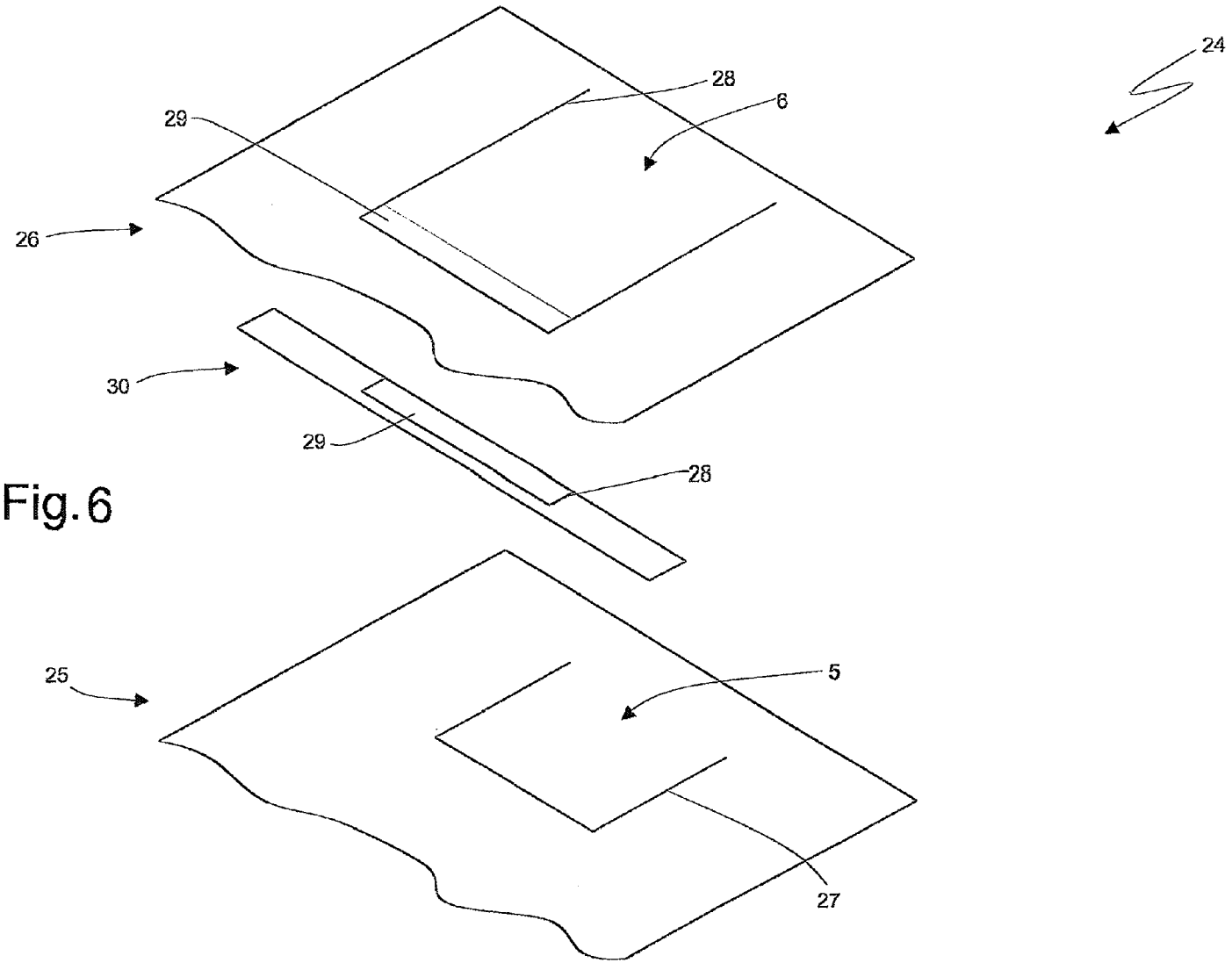
FIG. 6 shows an exploded view in perspective of part of the FIG. 5 sheet of packing material.

As shown in FIGS. 5 and 6, sealed wrapping 3 is formed by folding a rectangular sheet 24 of multilayer packing material formed by superimposing and gluing together at least two layers 25 and 26. Each layer 25, 26 of sheet 24 of multilayer packing material may be made of one material, or in turn also be multilayer, i.e. comprise a number of superimposed layers. The way in which sheet 24 of packing material is folded and stabilized about group 4 of cigarettes is known and described, for example, in Patent Applications IT2009B000339 and EP2008935A1, which are included herein by way of reference.

Sheet 24 of packing material comprises an inner layer 25, which, in sealed wrapping 3, is positioned directly contacting group 4 of cigarettes; and an outer layer 26 located on the outside of sealed wrapping 3. Inner layer 25 has a U-shaped incision 27 defining withdrawal opening 5 (i.e. in no way affecting outer layer 26); and outer layer 26 has a U-shaped incision 28 (the same shape as incision 27) which is located outwards of incision 27, surrounds incision 27 on three sides, in no way affects inner layer 25, and defines the edges of a reclosable sealing panel 6 for closing cigarette withdrawal opening 5. Sealing panel 6 normally adheres to the rest of sealed wrapping 3 to seal withdrawal opening 5, and can be detached temporarily from the rest of sealed wrapping 3 to open, and so withdraw a cigarette through, withdrawal opening 5.

It is important to note that each incision 27, 28 may be either complete (i.e. define from the outset a continuous clean cut through respective layer 25, 26) or partial (i.e. initially define a weakened portion of respective layer 25, 26, which, when sealed wrapping 3 is unsealed, produces a continuous clean tear through respective layer 25, 26). Incisions 27, 28 are preferably partial, to avoid excessively weakening sheet 24 of packing material as it is being folded, and may be partial in the sense of only being made through part of the thickness of respective layers 25, 26 (i.e. not being through incisions), or being made in the form of perforations (i.e. forming respective perforated tear lines).

Outer layer 26 is glued to inner layer 25 by applying non-dry, re-stick adhesive between them (i.e. adhesive allowing layers 25 and 26 to be detached, even a long time afterwards, and stuck back together again repeatedly). In a preferred embodiment, the non-dry, re-stick adhesive is applied to outer layer 26 (i.e. to the surface of outer layer 26 eventually contacting inner layer 25) before applying outer layer 26 to inner layer 25. The non-dry, re-stick adhesive between outer layer 26 and inner layer 25 glues the portion of inner layer 25 bounded by incision 27 (i.e. at withdrawal opening 5) permanently (i.e. non-detachably) to sealing panel 6 bounded by incision 28, so that, when sealing panel 6 is lifted off sheet 24 of packing material, the portion of inner layer 25 bounded by incision 27 (i.e. at withdrawal opening 5) is raised together with sealing panel 6 to uncover withdrawal opening 5. The non-dry, re-stick adhesive between outer layer 26 and inner layer glues the portion of inner layer 25 surrounding incision 27 (i.e. surrounding withdrawal opening 5) temporarily (i.e. detachably) to sealing panel 6, so sealing panel 6 is normally maintained contacting sheet 24 of packing material, to seal withdrawal opening 5.

In a preferred embodiment, sealing panel 6 has a grip tab 29, which has no re-stick adhesive on the side facing inner layer 25, is located close to, normally beneath, withdrawal opening 5, and provides for easy grip and lift of sealing panel 6. In other words, to lift sealing panel 6, the user simply grips tab 29, which is in no way fixed to inner layer 25, unlike the rest of sealing panel 6.

In one embodiment, to form grip tab 29, outer layer 26 is gummed selectively, i.e. all over, except for tab 29. In other words, having no adhesive on the side facing inner layer 25, tab 29 may be formed by simply not applying adhesive at all to the tab 29 portion. Though simple in theory, this method is difficult to implement, by involving a high degree of precision when applying the adhesive to outer layer 26, and above all when applying outer layer 26 to inner layer 25.

In a preferred embodiment, grip tab 29 is formed by inserting an intermediate layer 30 between outer layer and inner layer 25, at the grip tab 29 area. Intermediate layer 30 has no adhesive applied, and so on one side adheres to outer layer 26 (applied with adhesive), but does not adhere to inner layer 25, by having no adhesive on the side facing inner layer 25. In the area occupied by intermediate layer 30, outer layer 26 is thus prevented by intermediate layer 30 from adhering to inner layer 25. It is important to note that, because part of intermediate layer 30 forms part of sealing panel 6 (i.e. forms part of grip tab 29 of sealing panel 6), incision 28 also involves intermediate layer 30; and intermediate layer 30 is located close to, but strictly outwards of, withdrawal opening 5 (i.e. in no way overlaps withdrawal opening 5).

In the FIGS. 5 and 6 embodiment, intermediate layer 30 is in the form of a strip of limited length, and of the same width as layers 25 and 26 (i.e. extends outwards of grip tab 29 and therefore of sealing panel 6). The part of intermediate layer 30 outwards of sealing panel 6 and not forming grip tab 29 in a sense serves no purpose. So, in a different embodiment, intermediate layer 30 could be limited to the grip tab area (i.e. beneath sealing panel 6), but an intermediate layer 30 as shown in FIGS. 5 and 6 (i.e. of the same width as layers 25 and 26) is easier to apply. Moreover, besides forming grip tab 29, intermediate layer 30 also provides for stiffening sheet of packing material at withdrawal opening 5 (thus preventing collapse of sealed wrapping 3 when half-empty, and making sealing panel 6 easier to close). An oversized intermediate layer 30 (i.e. extending outwards of grip tab 29 as shown in FIGS. 5 and 6) adds much more stiffness to sheet 24 of packing material at withdrawal opening 5, thus improving the shape stability of sealed wrapping 3 when half-empty, and making sealing panel 6 easier to close.

Figure 7:
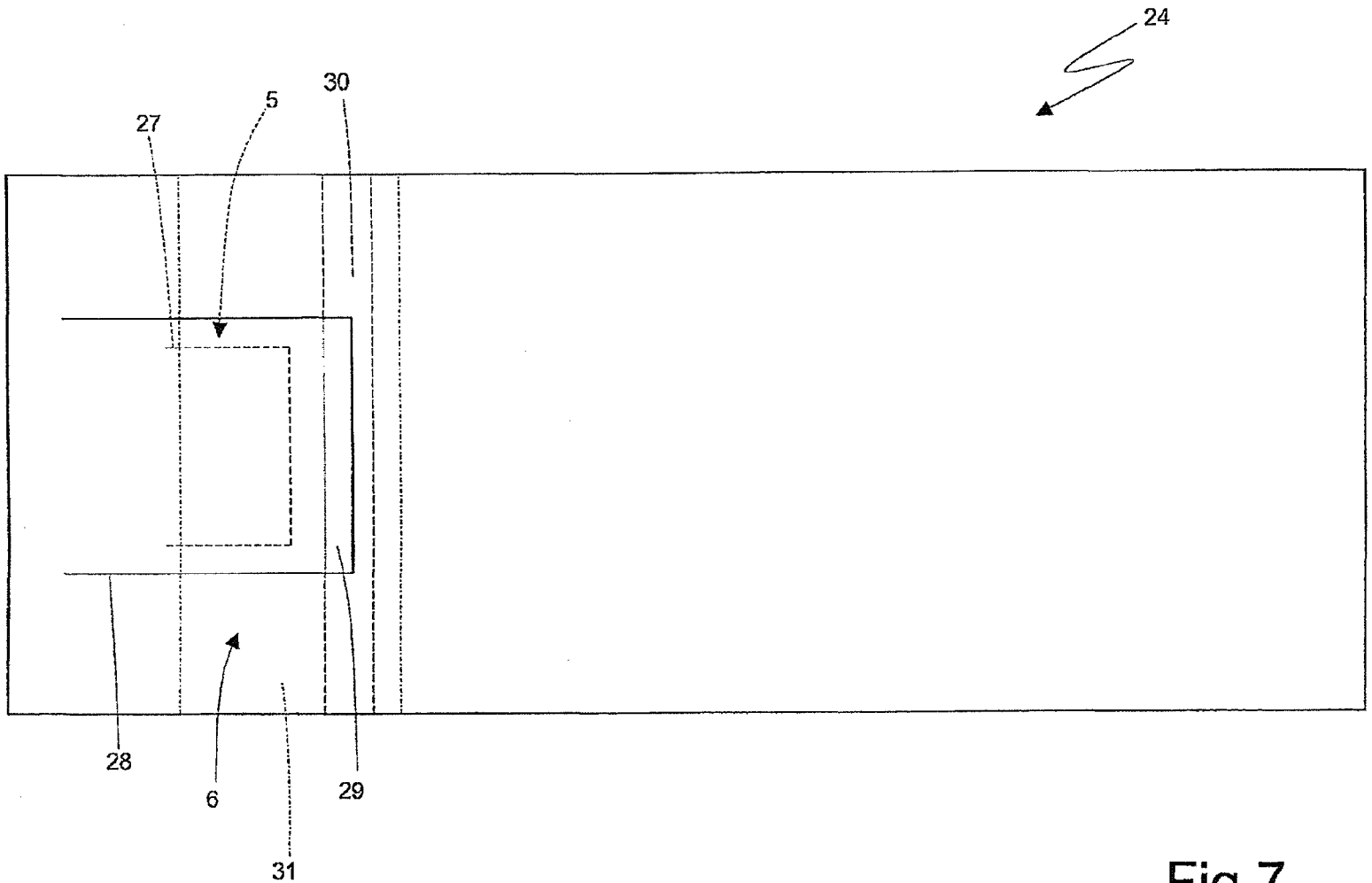
FIG. 7 shows a plan view of a variation of the sheet of multilayer packing material in FIG. 5.
Figure 8:
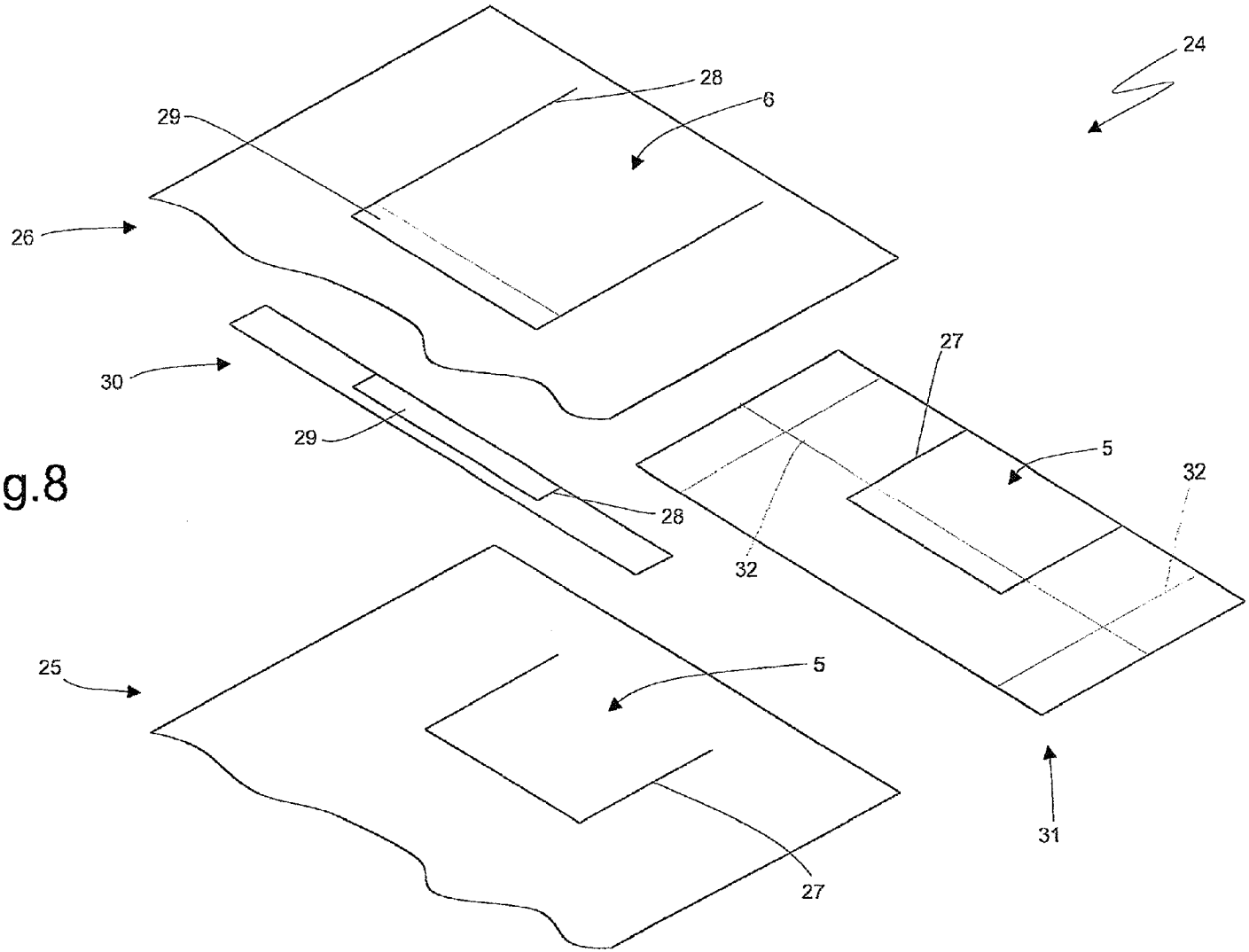
FIG. 8 shows an exploded view in perspective of part of the FIG. 7 sheet of packing material.

In the FIGS. 7 and 8 variation, sheet 24 of packing material comprises a stiffening layer 31 interposed between inner layer 25 and outer layer 26 at withdrawal opening 5. Stiffening layer 31 is preferably glued to both inner layer 25 and outer layer 26, i.e. is glued on one side to inner layer 25, and on the opposite side to outer layer 26. Alternatively, stiffening layer 31 is glued to inner layer 25 or outer layer 26 only. Whichever the case, stiffening layer 31 must be glued to outer layer 26 using non-dry, re-stick adhesive, but may be glued to inner layer 25 using non-dry, re-stick adhesive or permanent adhesive. That is, sealing panel 6 forming part of outer layer 26 must always be detachable from stiffening layer 31 (and from inner layer 25 underneath) for access to withdrawal opening 5.

Stiffening layer 31 serves to stiffen sealed wrapping 3 at withdrawal opening 3. As stated, stiffening sheet 24 of packing material at withdrawal opening 5 prevents collapse of sealed wrapping 3 when half-empty (thus simplifying withdrawal of the cigarettes through opening 5 when sealed wrapping 3 is half-empty) and makes sealing panel 6 easier to close.

In one embodiment, stiffening layer 31 has fold lines 32 along the folds made in sheet 24 of packing material when forming sealed wrapping 3. Being relatively thick and stiff, stiffening layer 31, in the absence of fold lines 32, would make sheet 24 of packing material difficult to fold, and, once folded inside sealed wrapping 3, could exert relatively strong springback pressure resulting in deformation of sealed wrapping 3.

Figure 9:
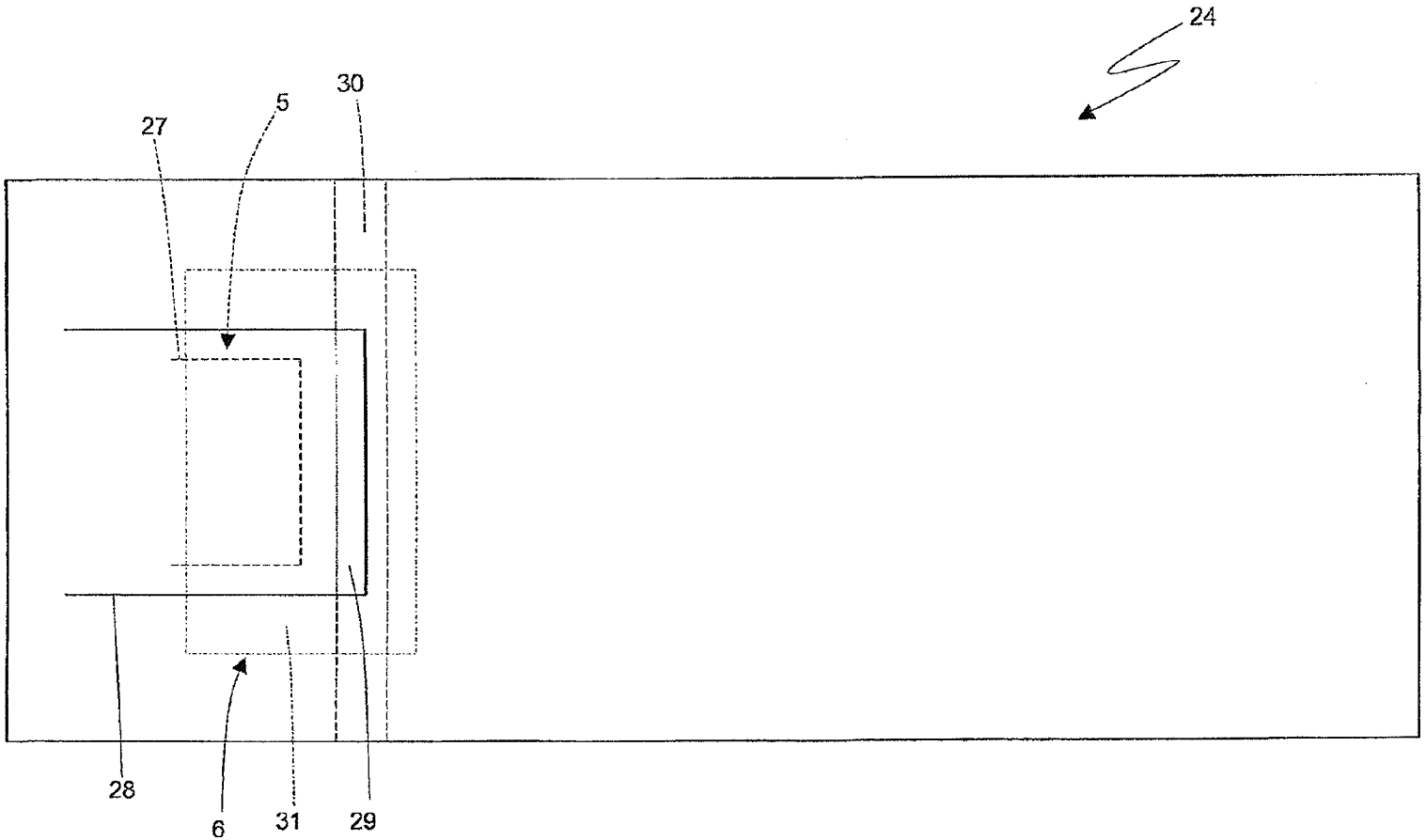
FIG. 9 shows a plan view of a further variation of the sheet of multilayer packing material in FIG. 5.
Figure 10:
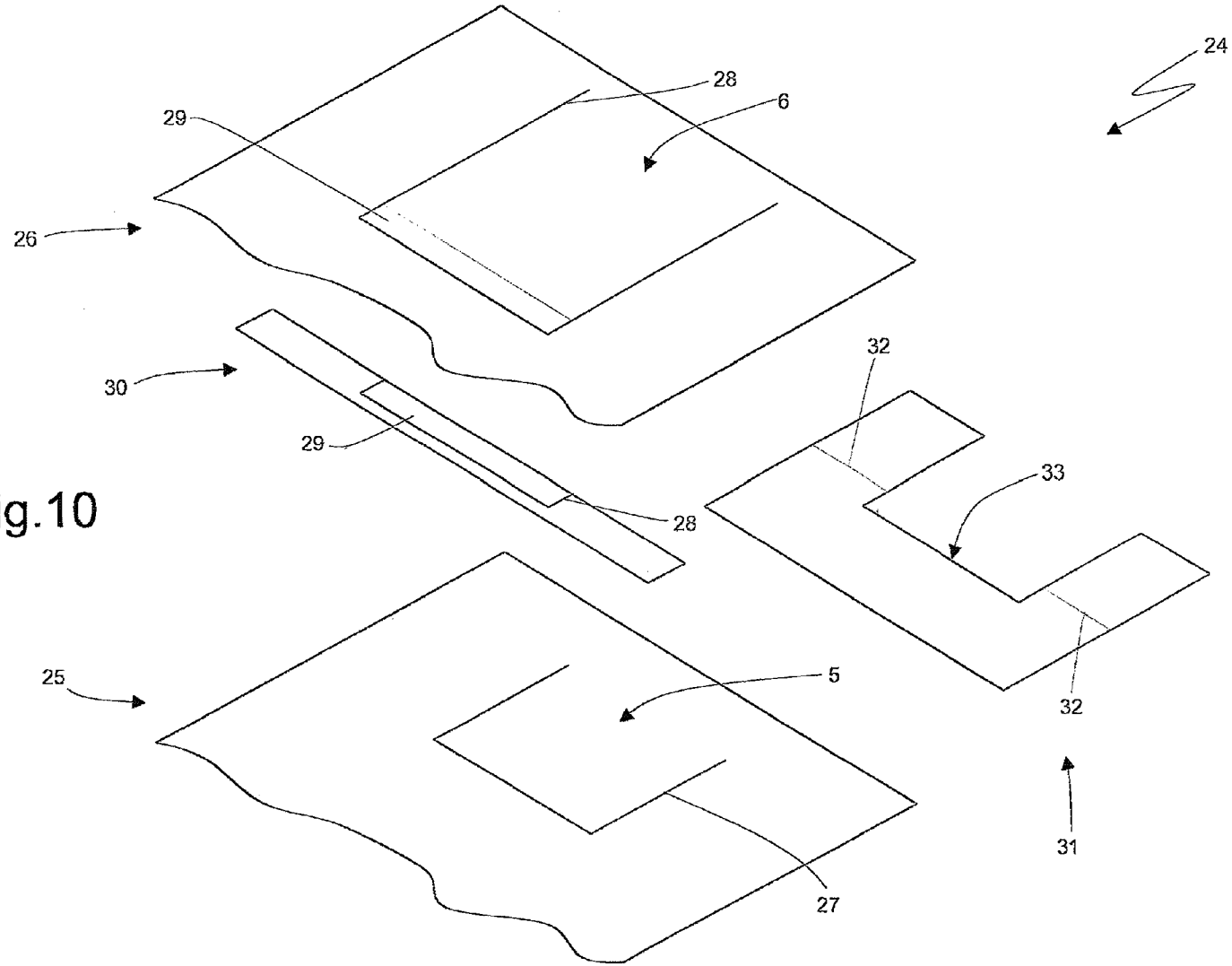
FIG. 10 shows an exploded view in perspective of part of the FIG. 9 sheet of packing material.

In the FIGS. 7 and 8 embodiment, stiffening layer 31 is glued to inner layer 25 and is affected by incision 27, which also defines withdrawal opening 5 in stiffening layer 31. Alternatively, in the FIGS. 9 and 10 embodiment, stiffening layer 31 has a through opening 33 superimposed over withdrawal opening 5 in inner layer 25, and which is no smaller than (i.e. is the same size as or larger than) withdrawal opening 5.

In the FIGS. 7 and 8 embodiment, stiffening layer 31 is of limited length and the same width as layers 25 and 26. Alternatively, in the FIGS. 9 and 10 embodiment, stiffening layer 31 is shorter and narrower than layers 25 and 26.

In the embodiments shown in the drawings, inner layer 25 and outer layer 26 are the same size as sheet 24 of packing material as a whole (i.e. cover the whole of sheet 24 of packing material). In an equivalent embodiment not shown, inner layer 25 or outer layer 26 is smaller than sheet 24 of packing material (i.e. covers only part of sheet 24 of packing material). In a first variation, inner layer 25 is the same size as sheet 24 of packing material as a whole (i.e. covers the whole of sheet 24 of packing material), and outer layer is smaller than sheet 24 of packing material as a whole and, therefore, inner layer 25 (i.e. only covers the area close to withdrawal opening 5). In a second variation, outer layer 26 is the same size as sheet 24 of packing material as a whole (i.e. covers the whole of sheet 24 of packing material), and inner layer 25 is smaller than sheet 24 of packing material as a whole and, therefore, outer layer 26 (i.e. only covers the area close to withdrawal opening 5).

In the embodiment shown in the drawings, sealing panel 6 is positioned with grip tab 29 on the front wall of sealed wrapping 3, and is therefore opened upwards (i.e. from the front wall to the top wall of sealed wrapping 3), and a top portion of sealing panel 6 remains attached to the top wall of sealed wrapping 3. In a variation not shown, sealing panel 6 is positioned with grip tab 29 on the top wall of sealed wrapping 3, and is therefore opened downwards (i.e. from the top wall to the front wall of sealed wrapping 3), and a bottom portion of sealing panel 6 remains attached to the front wall of sealed wrapping 3. For easy grip, all or only part of grip tab 29 may project from the top wall of sealed wrapping 3 towards the rear wall of sealed wrapping 3.

In one embodiment, sealed wrapping 3 is glued to collar 17 to prevent collapse of sealed wrapping 3, and so withdraw the remaining cigarettes more easily, when sealed wrapping 3 is half-empty. More specifically, sealed wrapping 3 is glued to lateral walls 19 of collar 17 (which are located on either side of withdrawal opening 5 and so maintain the right shape of sealed wrapping 3, even when half-empty), and may also be glued optionally to front wall 18 of collar 17 (which, being located below withdrawal opening 5, is less effective in maintaining the right shape of sealed wrapping 3 when half-empty). In a different embodiment (not shown), instead of a cardboard outer container 2, packet 1 of cigarettes comprises a soft outer package partly enclosing sealed wrapping 3, and leaving at least the top wall of sealed wrapping 3 exposed. In a further embodiment not shown, packet 1 of cigarettes only has sealed wrapping 3, and no outer container 2.

Figure 11:
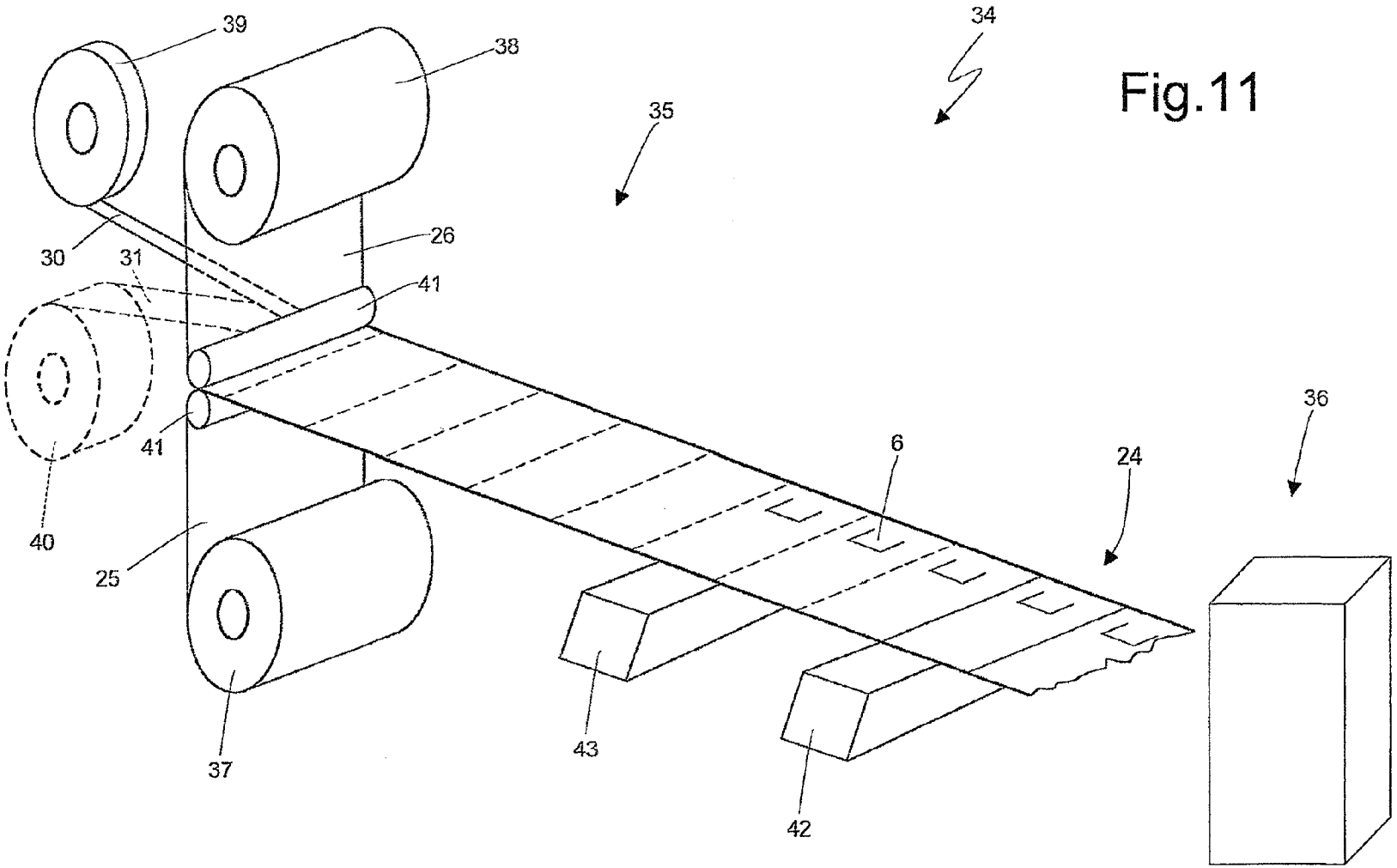
FIG. 11 shows a schematic view in perspective, with parts removed for clarity, of part of a packing machine for producing the inner wrapping of the FIG. 1-3 packet.

FIG. 11 shows a schematic view as a whole of a packing machine 34 for producing a packet 1 of cigarettes as described above and shown in FIGS. 1-10. Packing machine 34 comprises a forming station 35 for producing a succession of sheets 24 of multilayer packing material; and a packing station 36 (e.g. as described in Patent Applications IT2009B000339 and EP2008935A1) for folding each sheet 24 of multilayer packing material from forming station 35 about a group 4 of cigarettes, to form a sealed wrapping 3 enclosing group 4 of cigarettes.

At forming station 35, layers 25, 26, 30 (and stiffening layer 31, if any) are in the form of continuous strips unwound off respective reels 37-40, and are superimposed by a pressure roller device 41. More specifically, inner layer 25 is unwound off a reel 37, outer layer 26 off a reel 38, intermediate layer 30 off a reel 39, and stiffening layer 31 (if any) off a reel 40.

In a preferred embodiment, outer layer 26 is self-adhesive, i.e. is applied beforehand with non-dry, re-stick adhesive, and is therefore unwound off reel 38, ready to be superimposed on inner layer 25. Alternatively, a gumming device may be provided between reel 38 and pressure roller device 41 to apply non-dry, re-stick adhesive to outer layer 26. Likewise, stiffening layer 31, if any, is also applied beforehand with non-dry, re-stick adhesive; or a gumming device may be provided between reel 40 and pressure roller device to apply non-dry, re-stick adhesive to stiffening layer 31.

Downstream from pressure roller device 41, a cutting device 42 makes a transverse cut to cut off each sheet 24 of packing material.

Between pressure roller device 41 and cutting device 42, a mechanical or laser incision device 43 forms incisions 27 and 28 in (obviously on opposite sides of) each sheet 24 of packing material. In the embodiment shown, incisions 27 and 28 are both made after superimposing layers 25, 26, 30 (and stiffening layer 31, if any). Alternatively, one or both of incisions 27, 28 may be made before superimposing layers 25, 26, 30 (and stiffening layer 31, if any).

Figure 12:
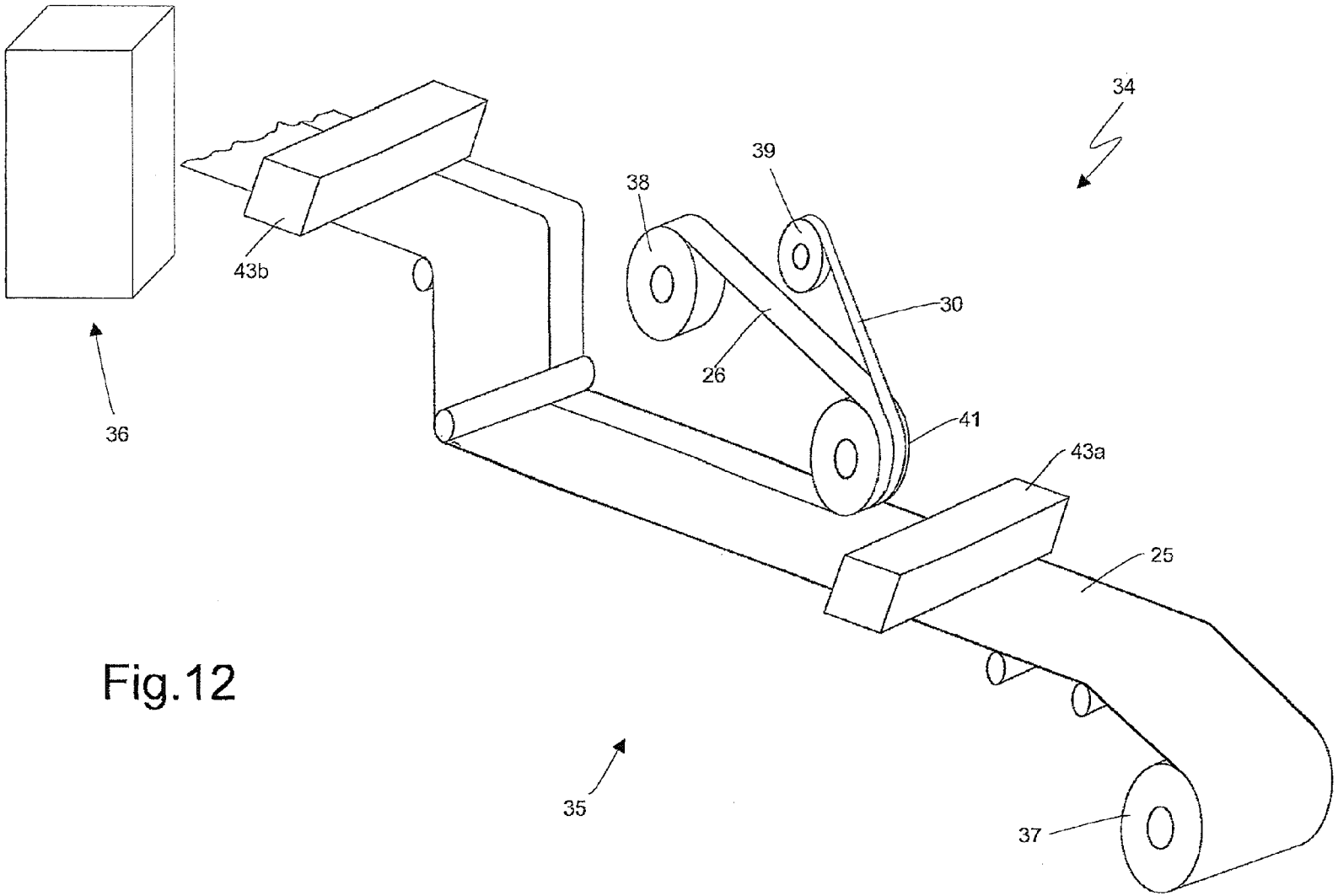
FIG. 12 shows a schematic view in perspective, with parts removed for clarity, of part of a further packing machine for producing the inner wrapping of the FIG. 1-3 packet.
Figure 13:
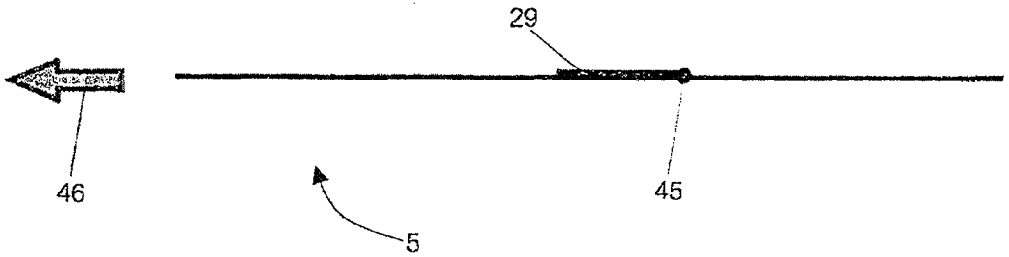
FIGS. 13-17 show the operating sequence of a creasing device of the FIGS. 11 and 12 packing machine.
Figure 14:
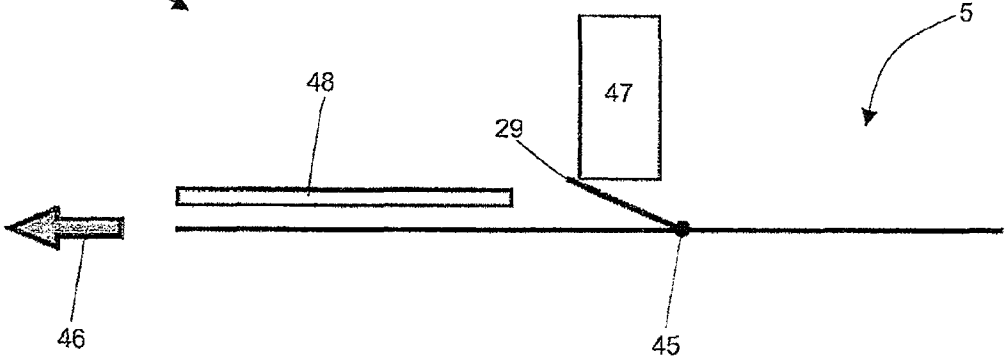
Figure 15:
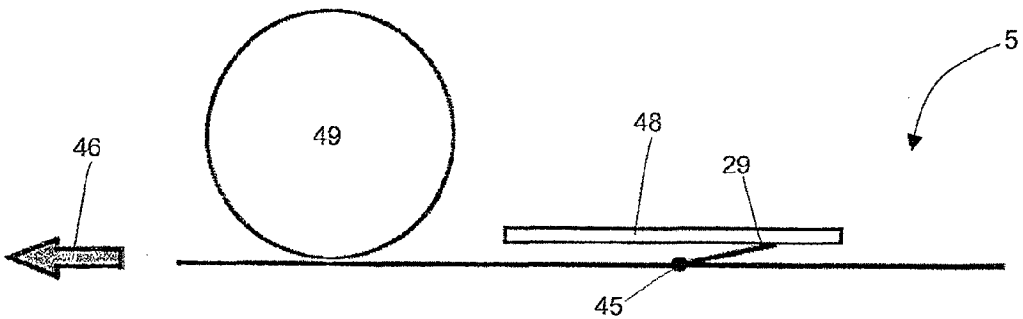
Figure 16:
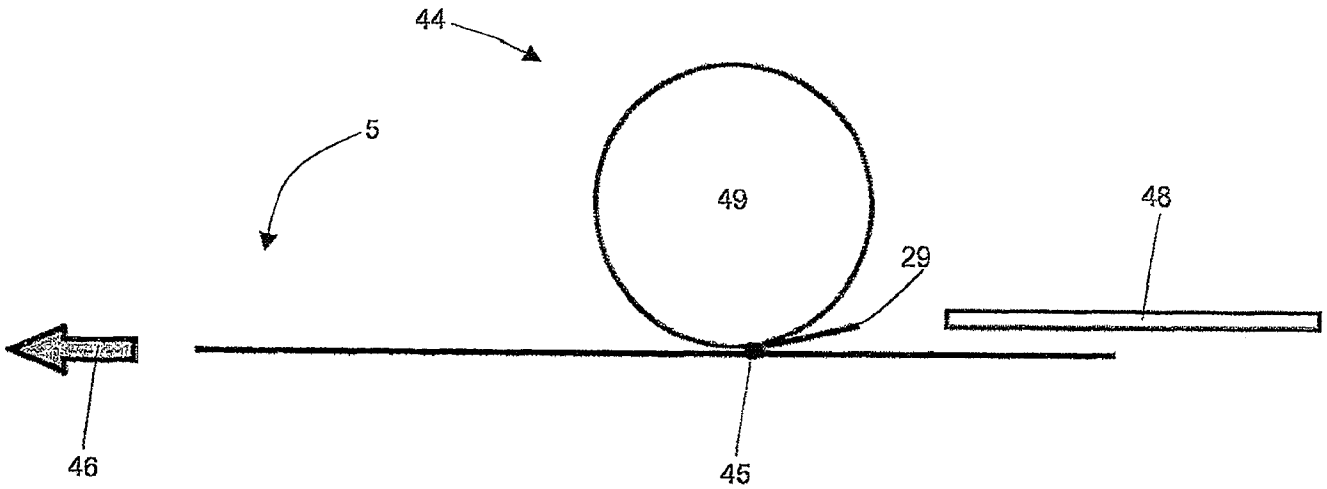

FIG. 12 shows a different embodiment of packing machine 34, in which the most striking difference is the size of outer layer 26 (much smaller than in FIG. 11). In FIG. 12, cutting device 42 is not shown, and incision device 43 is divided into two parts: 43*a* (for producing incision 27 in inner layer 25), and 43*b* (for producing incision 28 in outer layer 26).

Figure 17:
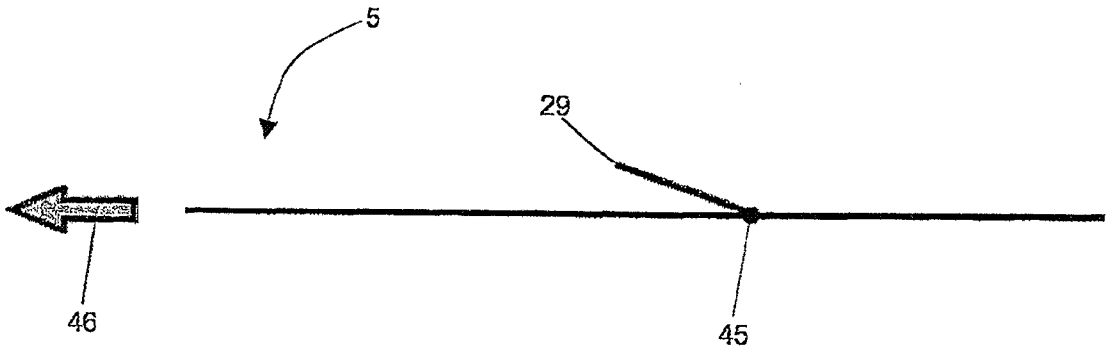

In one embodiment shown in FIGS. 13-17, packing machine 34 may comprise a creasing device 44 for forming, in each sheet 24 of packing material, a crease (or prefold) of grip tab 29 along a fold line 45 (FIGS. 12-16) separating grip tab 29 from the rest of sealing panel 6. The creasing or prefold operation comprises folding grip tab 29 along fold line 45 (normally by an angle of more than 90° and close to 180°), and then folding it in the opposite direction back into its original position, or simply allowing it to spring back. Creasing or prefolding grip tab 29 along fold line 45 produces permanent deformation of the fibres of grip tab 29 astride fold line 45, so that grip tab 29 naturally tends to spring back up off sealing panel 6 (as shown in FIG. 17), thus making it easier to grip by the user of packet 1 of cigarettes.

Creasing device 44 operates as sheet 24 of packing material is fed along a feed path 46, and comprises a lifting device 47, which lifts grip tab 29 slightly by suction off the rest of sheet 24 of packing material (i.e. folds grip tab 29 roughly 20-30° about fold line 45; a fixed folding device 48 located immediately downstream from lifting device 47, and which engages grip tab 29 raised beforehand by lifting device 47, to fold grip tab 29 almost 180° about fold line 45; and a folding roller 49 located immediately downstream from fixed folding device 48, and which engages grip tab 29 folded by fixed folding device 48, to exert relatively high pressure on and fold grip tab 29 180° about fold line 45.

Packet 1 of cigarettes described has numerous advantages. Sealing panel 6 being integrated in outer layer 26, sheet 24 of packing material can be formed by superimposing layers 25 and 26 on the packing machine itself, before folding sheet 24 of packing material about group 4 of cigarettes. Once formed, sheet 24 of multilayer packing material can therefore be used immediately, without being rewound into a reel and later unwound; and all the reels on the packing machine therefore contain strip material of uniform thickness, with no unevenness.

Sealed wrapping 3 ensures excellent protection of the cigarettes inside from external agents, and so preserves the organoleptic characteristics of the tobacco for a long period of time.

Finally, sealed wrapping 3 (despite the limited overall amount of material needed to produce it) is exceptionally strong around withdrawal opening 5, particularly when a stiffening layer 31 is also provided, and so does not collapse when half-empty (thus simplifying withdrawal of the remaining cigarettes, and making sealing panel 6 easier to close).

Given its numerous advantages, the package described may also extend to articles other than cigarettes, e.g. foodstuffs (sweets, chocolates or other confectionary items).

The invention claimed is:

1. A package of cigarettes comprising:

a group (4) of cigarettes; and a sealed wrapping (3) which encloses the group (4) of cigarettes, has a cigarette withdrawal opening (5) closed by a reclosable sealing panel (6), and is made from a sheet (24) of multilayer packing material comprising at least an outer layer (26) and an inner layer (25) that is superimposed with the outer layer (26);

wherein the inner layer (25) has a U-shaped first incision (27) defining the withdrawal opening (5);

wherein the outer layer (26) is larger than the sealing panel (6), and has a U-shaped second incision (28) that defines the edges of the sealing panel (6);

wherein the second incision (28) has a second perimeter greater than a first perimeter of the first incision (27), bounds a second area larger than a first area bounded by the first incision (27), is not superimposed and aligned to the first incision (27), circumscribes the first incision (27), is located outwards of the first incision (27), and surrounds the first incision (27) on three sides;

wherein the outer layer (26) is glued to the inner layer (25) using non-dry, re-stick adhesive; the sealing panel (6) has a grip tab (29) located close to the withdrawal opening (5) and having no re-stick adhesive on the side facing the inner layer (25); and wherein an intermediate layer (30) is interposed between the outer layer (26) and the inner layer (25) at the grip tab (29), has no re-stick adhesive on the side facing the inner layer (25), and is affected by the second incision (28).

2. A package as claimed in claim 1, wherein one side of the intermediate layer (30) adheres to the outer layer (26), and the other side of the intermediate layer (30) does not adhere to the inner layer (25).

3. A package as claimed in claim 1, wherein the intermediate layer (30) extends outwards of the grip tab (29) and the sealing panel (6), close to and outwards of the withdrawal opening (5).

4. A package as claimed in claim 1, wherein the intermediate layer (30) is limited to the grip tab (29) area, and only extends beneath the sealing panel (6).

5. A package as claimed in claim 1, and comprising a stiffening layer (31) interposed between the inner layer (25) and the outer layer (26) at the withdrawal opening (5), and integral with at least the inner layer (25) or the outer layer (26).

6. A package as claimed in claim 5, wherein the stiffening layer (31) is integral with both the inner layer (25) and the outer layer (26).

7. A package as claimed in claim 5, wherein the stiffening layer (31) is glued to the outer layer (26) with non-dry, re-stick adhesive.

8. A package as claimed in claim 5, wherein the stiffening layer (31) has fold lines (32) along the folds made in the sheet (24) of packing material when forming the sealed wrapping (3).

9. A package as claimed in claim 5, wherein the first incision (27) involves the stiffening layer (31), and also defines the withdrawal opening (5) in the stiffening layer (31).

10. A package as claimed in claim 5, wherein the stiffening layer (31) has a through opening (33) superimposed over the withdrawal opening (5) in the inner layer (25).

11. A package as claimed in claim 5, wherein the stiffening layer (31) is of limited size and only located at and about the withdrawal opening (5).

12. A package as claimed in claim 1, and comprising a rigid outer container (2) housing the sealed wrapping (3).

13. A package as claimed in claim 12, wherein:

the rigid outer container (2) is cup-shaped, and comprises an open top end (7), and a cup-shaped lid (8) hinged to the outer container (2) along a hinge (9) to rotate, with respect to the outer container (2), between an open position and a closed position opening and closing the open top end (7) respectively;

a U-folded collar (17) is fixed to the inside of the outer container (2) to project partly outwards of the open top end (7) and engage a corresponding inner surface of the lid (8) when the lid is in the closed position; and the sealed wrapping (3) is fixed to the collar (17).

14. A package of cigarettes comprising:

a group (4) of cigarettes;

a sealed wrapping (3) which encloses the group (4) of cigarettes, has a cigarette withdrawal opening (5) closed by a reclosable sealing panel (6), and is made from a sheet (24) of multilayer packing material comprising at least an outer layer (26), and an inner layer (25) that has a U-shaped first incision (27) defining the withdrawal opening (5) and is superimposed with the outer layer (26); and a stiffening layer (31) interposed between the inner layer (25) and the outer layer (26) at the withdrawal opening (5), and integral with at least the inner layer (25) or the outer layer (26);

wherein the outer layer (26) is larger than the sealing panel (6), and has a U-shaped second incision (28) located outwards of the first incision (27), surrounding the first incision (27) on three sides, and defining the edges of the sealing panel (6);

wherein the outer layer (26) is glued to the inner layer (25) using non-dry, re-stick adhesive; the sealing panel (6) has a grip tab (29) located close to the withdrawal opening (5) and having no re-stick adhesive on the side facing the inner layer (25); and wherein an intermediate layer (30) is interposed between the outer layer (26) and the inner layer (25) at the grip tab (29), has no re-stick adhesive on the side facing the inner layer (25), and is affected by the second incision (28).

15. A package as claimed in claim 14, wherein the stiffening layer (31) is integral with both the inner layer (25) and the outer layer (26).

16. A package as claimed in claim 14, wherein the stiffening layer (31) is glued to the outer layer (26) with non-dry, re-stick adhesive.

17. A package as claimed in claim 14, wherein the stiffening layer (31) has fold lines (32) along the folds made in the sheet (24) of packing material when forming the sealed wrapping (3).

18. A package as claimed in claim 14, wherein the first incision (27) involves the stiffening layer (31), and also defines the withdrawal opening (5) in the stiffening layer (31).

19. A package as claimed in claim 14, wherein the stiffening layer (31) has a through opening (33) superimposed over the withdrawal opening (5) in the inner layer (25).

20. A package as claimed in claim 14, wherein the stiffening layer (31) is of limited size and only located at and about the withdrawal opening (5).

* * * * *